United States Patent [19]

Sirkis

[11] Patent Number: 4,714,810

[45] Date of Patent: Dec. 22, 1987

[54] MEANS AND METHODS FOR HEATING SEMICONDUCTOR RIBBONS AND WAFERS WITH MICROWVAES

[75] Inventor: Murray D. Sirkis, Tempe, Ariz.

[73] Assignee: Arizona Board of Regents, Tempe, Ariz.

[21] Appl. No.: 890,406

[22] Filed: Jul. 28, 1986

[51] Int. Cl.[4] ..... H05B 6/70

[52] U.S. Cl. ..... 219/10.55 M; 219/10.55 A; 219/10.57

[58] Field of Search ..... 219/10.55 A, 10.55 R, 219/10.55 E, 10.55 F, 10.55 D, 10.55 M, 10.57

[56] References Cited

U.S. PATENT DOCUMENTS 3,083,528 4/1963 Brown ..... 219/10.55 R 4,476,363 10/1984 Berggren et al. ..... 219/10.55 M

*Primary Examiner*—Robert S. Macon

*Attorney, Agent, or Firm*—Richard R. Mybeck

[57] ABSTRACT

Means and method including a novel waveguide sample holder for applying traveling microwaves to heat thin low-resistivity semiconductor ribbons and wafers without a susceptor. Traveling microwaves are applied to the semiconductor materials, both with and without a traveling wave resonator. Efficient coupling is obtained by unique placement of the samples in the waveguide.

19 Claims, 6 Drawing Figures

MEANS AND METHODS FOR HEATING SEMICONDUCTOR RIBBONS AND WAFERS WITH MICROWVAES

INTRODUCTION

The present invention relates to means and methods for manufacturing and more particularly, to improved means and methods of applying a traveling microwave i.e., a wave traveling in only one direction along the longitudinal axis of the waveguide, to heat thin, low-resistivity semiconductor ribbons and wafers disposed therein without requiring the use of a susceptor therewith.

BACKGROUND OF THE INVENTION

A typical procedure in which semiconductor devices are fabricated from wafers entails heating the wafers during several process steps. In contemporary practice, wafers are routinely heated with resistance furnaces, infrared or quartz-halogen lamps, electron beams, and lasers. In some applications, radio frequency energy is used to heat a susceptor from which the thermal energy is transferred to a wafer by conduction, convection, or radiation.

The principal problem associated with the utilization of an apparatus for microwave heating of low-resistivity semiconductor ribbons and wafers without a susceptor is the creation of an efficient applicator, i.e., the device with which the microwave energy is applied to the sample to be heated. Previous attempts to heat ribbons and wafers in this manner failed to provide either efficient coupling of the microwave energy into the sample or uniformity of heating.

The present invention relates to innovative means and methods of applying traveling microwaves to thin low resistive semiconductor pieces and, more particularly, to means and methods of heating semiconductor ribbons or wafers directly by microwave energy without using a susceptor. The elimination of the susceptor is highly desirable because it obviates the need for efficient heat transfer between the susceptor and the wafer and eliminates the possibility of wafer contamination by the hot susceptor. The realization of this goal thus provides important and unique means and methods for the diffusion, drying, sintering and rapid annealing of such wafers and ribbons which means and methods are both convenient and cost effective.

Prior attempts, albeit less than highly successful, have been described in the literature for somewhat similar problems. For example, Guidici (Siltec Corporation, Menlo Park, CA.) described experiments for producing photovoltaic devices in which coin-stacked wafers were placed in a microwave applicator and heated to 900° C. The absorption of microwave radiation near the exterior surfaces of the stack generated heat which was transmitted to the interior of the stack by thermal conduction. Guidici has used the same apparatus for sintering metallization coatings on single wafers.

Other experiments in which microwave energy was used to heat a small silicon sample were recently described by Chenevier et al at CNRS in Grenoble. (See: Pulsed annealing of semiconductors by microwave energy, Chenevier et al *J. Physique-LETTERS,* 43 (1982) L-291-294). The principal feature of the CNRS method was the use of the small silicon sample as part of the wall of a standing-wave resonator made from x-band waveguide. When the resonator is excited by the microwave field, the wall currents resulting from the microwave field heat the sample because of its non-zero resistivity. The procedure is alleged to be energy efficient (up to 30% is claimed), and the apparatus required to implement it is quite conventional. To facilitate absorption of microwave energy by a cool sample of relatively high resistivity, Chenevier et al use an incandescent lamp to decrease the resistivity of the sample by photo-excitation of carriers. This procedure is, however, suitable only for small samples as both thermal and electrical problems occur at the sample edges.

It is apparent that a clear and present need still exists for the development of means and methods of applying microwaves to heat thin low-resistivity semi-conductor ribbons and wafers without requiring the use of a susceptor therewith. It is toward this need that the present invention is directed.

Accordingly, a principal object of the present invention is to provide new and improved means and methods for heating low-resistivity materials, such as semiconductor materials with microwaves without a susceptor whereby the material being heated is the hottest body within the applicator and the possibility of contaminating the sample by a susceptor is eliminated.

Another object of the present invention is to provide a new and improved method of heating semiconductor materials which has a relatively short process time because the microwave energy is dissipated directly into the semiconductor samples rather than to and through a susceptor.

A further object of the present invention is to provide new and improved means and methods for heating low-resistivity materials such as semiconductor materials with microwaves which have substantially enhanced energy efficiency.

These and still further objects as shall hereinafter appear are readily fulfilled by the present invention in a remarkably unexpected manner as will be readily discerned from the following detailed description of an exemplary embodiment thereof especially when read in conjunction with the accompanying drawing in which like parts bear like numerals throughout the several views.

DESCRIPTION OF PREFERRED EMBODIMENTS

The key to the present invention resides in the means and methods of presenting ribbons and wafers to a microwave heat source for efficient and uniform heating to dry or cure the ribbons/wafers and/or diffuse impurities thereinto.

The embodiment herein described and illustrated employs a traveling wave wherein the samples are maintained within a sample holder placed in a stationary position relative to the wave source.

As will appear, efficient coupling and uniformity of heating are obtained by placing each ribbon in what is effectively a wall of an individual waveguide within a composite waveguide arrangement.

Ideally, the use of a semiconductor sample as part of a wall if a microwave structure will not interrupt wall currents of arcing and undesirable losses of microwave energy through the openings between the sample and the rest of the structure are to be avoided. Note that when a wafer or ribbon is used to replace a section of one of the broad walls in a rectangular waveguide in which the so-called dominant mode is present, any gap between the ribbon and the remainder of the waveguide will, in general, perturb the wall currents. As will be shown, the means of the present invention eliminates this difficulty by placing the sample so it functions as part of a broad wall which is common to two waveguides, each of which supports a dominant wave propagating in the same direction. To achieve the desired result, the traveling waves in the two waveguides must be in phase. As an alternative, standing waves that are in phase in the two adjacent waveguides may be used. With either of these arrangements, the wall currents circulate around the sample, flowing in one direction on one side of the sample and in the opposite direction on the other side. At the same time, the currents in other surfaces adjacent to the sample remain essentially undisturbed. A similar situation occurs when the planar sample is placed in the interior of a rectangular waveguide so that its major planar surfaces are parallel to the broad walls of the waveguide. In this manner, as many as twenty to thirty uniformly spaced ribbons may be placed simultaneously in a single sample holder as is shown in FIG. 1.

Figure 1:
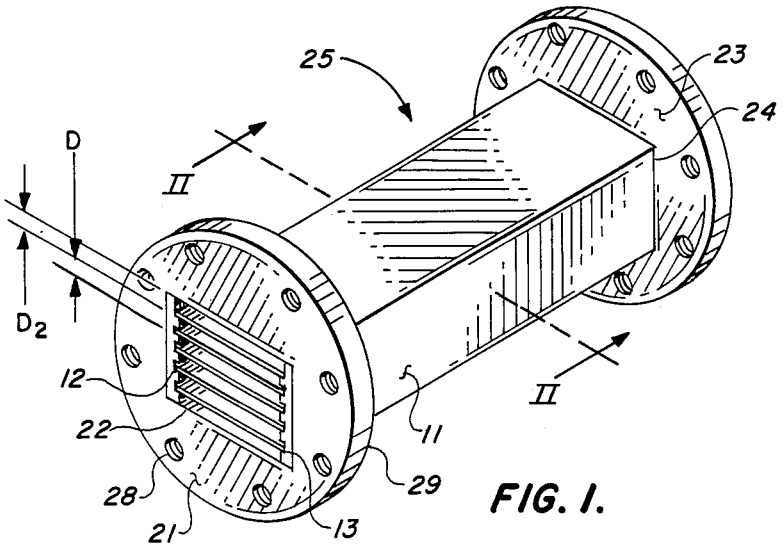
FIG. 1 is an isometric showing of a sample holder embodying the present invention.
Figure 2:
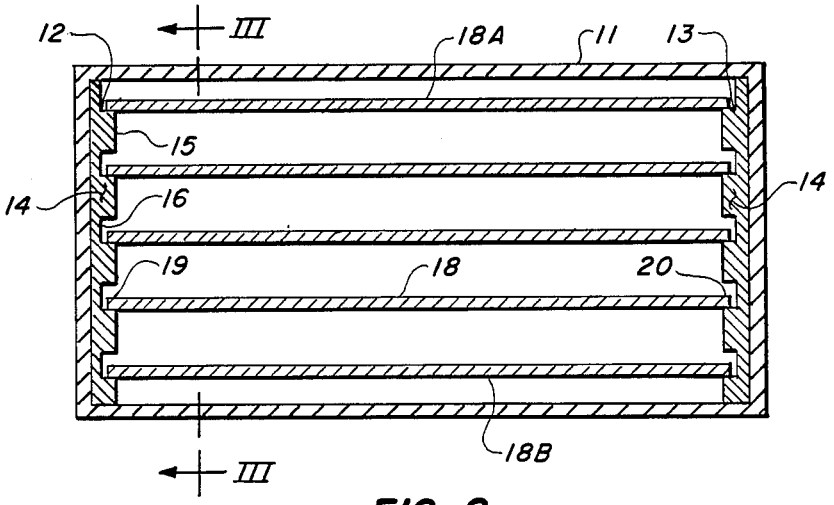
FIG. 2 is a cross section of a sample holder taken on line 2—2 of FIG. 1.
Figure 3:
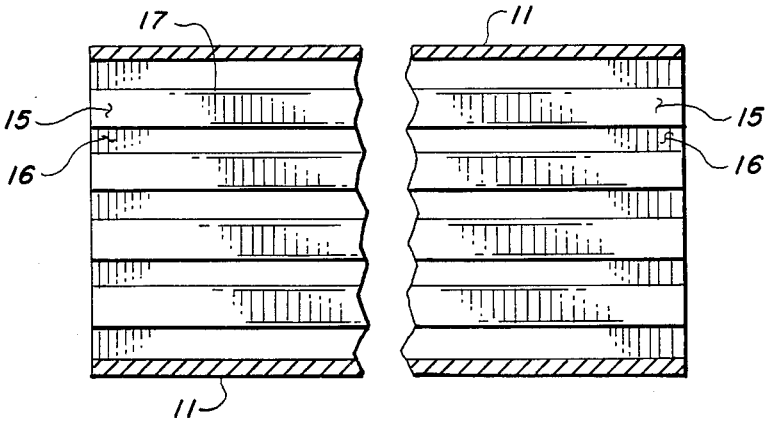
FIG. 3 is a frontal elevation of the shelf-like member of the sample holder of FIG. 1.

Referring to the drawings and particularly FIGS. 1, 2 and 3, sample holder 10 comprises a housing 11 formed of brass or aluminum or like alloys which is preferably shaped as an open-ended rectangular prism having a first and second shelf-like member, 12, 13 respectively, disposed one along each side thereof. Each shelf-like member, for example shelf-like member 13 is formed of heat resistant ceramic or quartz and comprises a body portion 14 and a plurality of spaced flange members 15 extending normal from body portion 14 and defining a plurality of channels 16 therebetween. As illustrated, each flange member 15 has a support surface 17 defined thereupon which, in one practice of this invention, will be disposed about 0.09 inches from the support surface 17 of the adjacent flange member 15.

As will appear, this dimension is identical to the distance (shown as "d") between the center lines of adjacent ribbons 18 and is equal to twice the distance (shown as "d/2") between the center line of the outermost ribbons, 18*a*, 18*b* and the housing wall 11 adjacent thereto. In this particular arrangement, the width of each channel 16 will be approximately 0.045 inches when support surfaces 17 are oriented in a horizontal plane and approximately 0.22 inches when support surfaces 17 are oriented in a vertical plane.

In use, a plurality of ribbons or wafers 18 will be positioned within sample holder 10 so that the proximal edge 19 of each is disposed upon one support surface 17 of shelf-like member 12 within channel 16 and the distal edge 20 thereof is disposed in the corresponding channel 16 upon the corresponding support surface 17 of shelf-like member 13. Ribbons/wafers 18 will be disposed into each tier of support surfaces 17 until all have a ribbon 18 disposed there upon. Within the preferred practice of this invention, members 12, 13 will be configured to provide between twenty and thirty pairs of corresponding cooperating support surfaces 17 will equally beneficial results. As used herein, ribbons, wafers, sheets and the like are used interchangeably to identify the thin semiconductor material embraced herein.

As shown in FIG. 1, housing 11 of the sample holder 10 shown in FIGS. 2 and 3, has a first flange or waveguide adapter 21 mounted at one end 22 thereof and a second similar adapter or flange 23 disposed at the other end 24 thereof to complete a sample holder assembly 25 which is attachable into a circuit which includes, inter alia, a suitable variable power source (oscillator) 26 (available as Model GL103 Power Source from Gerling Labs, Modesto, CA). Sample holder assembly 25 is connected into the desired circuit arrangement by abutting one waveguide flange adapter, e.g., 21, with a like annular flange 27 formed upon an adjacent component, aligning the several holes 28 which are equispaced about the perimeter 29 of adapter 21 in spaced inset relationship thereto with the corresponding holes 30 in flange 27 and passing suitable fasteners such as bolts, pins or the like 31 therethrough to secure sample holder assembly 25 to an adjacent component. Directional couplers, terminal loads, isolators and circulators, all standard components in microwave circuits, each have similar annular flange members formed thereon for convenient assembly to complete the microwave circuit. Each flange member is preferably formed of brass or similar alloy and the mating surfaces thereof will be machined to provide a tight surface-to-surface engagement between adjacent flanges.

Figure 4:
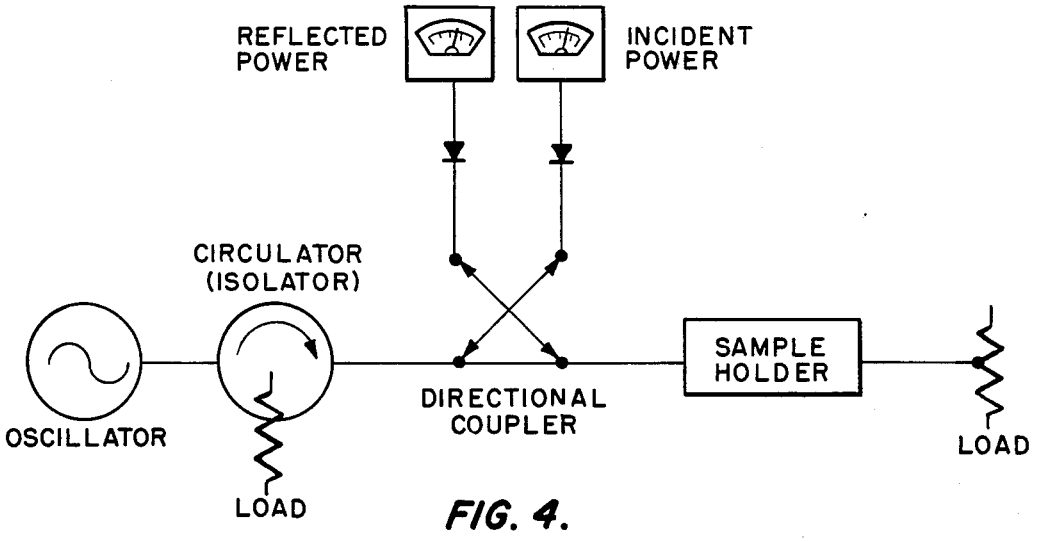
FIG. 4 is a circuit diagram for employing traveling-waves without a resonator in accordance with the present invention.
Figure 5:
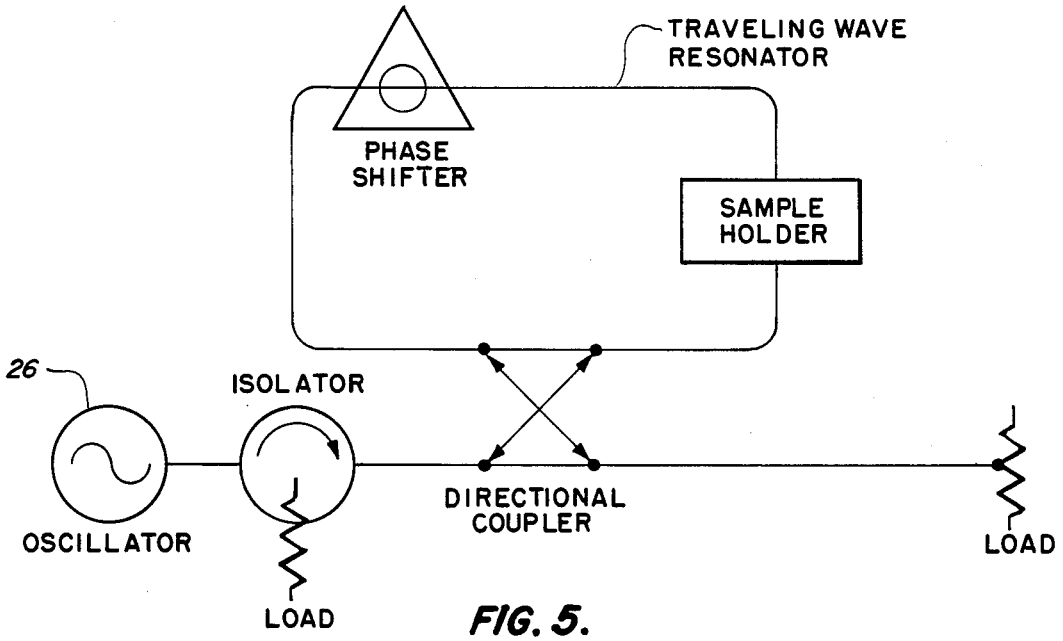
FIG. 5 is a circuit diagram for employing traveling-waves with a resonator in accordance with the present invention.
Figure 6:
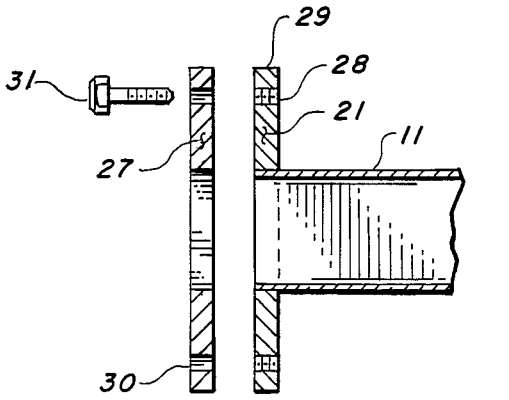
FIG. 6 is a sectional view of a flange adapter of a sample holder abutting an adjacent annular flange.

As shown in FIGS. 4 and 5, oscillator 26 can be activated by connection to a suitable source of power (such as standard 110V A.C. current) and will accomplish its desired effect upon the ribbons or wafers 18 disposed within sample holder 10 either with (see FIG. 5) or without (see FIG. 4) a resonator.

When the cost of the initial equipment is secondary to the actual operating cost, the circuit with the resonator is recommended because of its potential for high process efficiency with low energy loss except for the samples. However, where set up costs are more critical than operating costs, the circuitry of FIG. 4 which omits the resonantor is highly satisfactory.

One traveling-wave circuit useful in the practice of the present invention is shown in FIG. 4 wherein an oscillator is connected in series with a loaded circulator (isolater), a directional coupler, the sample holder and a terminal load. Both reflected power and incident power in the circuit are monitored by the directional coupler and power meters.

A second circuit configuration useful in the practice of the present invention when the traveling-wave resonator is desired is shown in FIG. 5. A variable directional coupler is used to tune the resonator to the microwave source frequency. The Q of the traveling-wave resonator will be in the order of 400 and the microwave source will have a commensurate frequency stability.

The several components of each of the foregoing circuits are clearly identified on the circuit of FIGS. 4 and 5 wherein conventional notations are employed and need not be further described here.

With traveling waves, the average power dissipation per unit area of sample surface for samples of practical lengths is virtually independent of the coordinate corresponding to the direction of propagation if the attenuation is not too great. Relatively small attenuations are acceptable in the system configuration which includes the traveling-wave resonator. Consequently, only the dependence on the transverse coordinates needs to be considered. As can be shown, the power dissipation per unit area of the sample is essentially independent of the transverse coordinates when the broad dimension of the wave guide is chosen so as to make the cutoff frequency of the dominant mode equal to about 0.7 of the operating frequency. Thus for the dedicated IMR and D band at 2.45 GHz, the optimum waveguide width is about 3.41 inches or a multiple thereof.

It is thus apparent that the present invention comprises an applicator for heating low-resistivity semiconductor ribbons, materials and like low-resistivity materials; that is, materials having resistivity in the range from 0.001 to 1.0 ohm-cm., in thin (e.g., circa 0.020 inches thick) ribbons, strips, wafers and like configurations without the use of a susceptor. Furthermore, planar samples of any shape may be used here with, subject only to the limitation imposed by the waveguide width. Where uniformity of heating is a prime requisite, a sample holder having a width that is 3.41 inches or an integral multiple of 3.41 in. permits samples that are both larger and smaller than 3.41 in. to be processed in the applicator with highly successful results. In those applications when uniformity of heating is not required or irregularity of heating (e.g., hot centers or hot edges) is sought, the specific width relationship enumerated above can be ignored.

Efficient coupling is obtained through placement of the samples in what are effectively the walls of waveguides within a composite waveguide in which the dominant mode propagates in each. Uniformity of heating, when the 3.41 relationship is applied, will be assured through the use of traveling-waves rather than standing-waves.

In one practice of the present invention, a sample holder embodying the present invention and holding up to 15 samples was fabricated from WR 284 waveguide. Its width is not the optimum value. Experimental data for traveling-wave configurations was obtained by measuring attenuation and VSWR (Voltage Standing Wave Ratio) on 0.02 inch thick silicon wafers with a nominal resistivity of 0.01 ohm-cm. A summary of the results and a comparison of experimental and theoretical values of the attenuation constant are shown in Table I, below.

TABLE I

| Number of Ribbons | Attenuation dB(Calc) | Attenuation dB(Meas.) | VSWR (Meas.) |
|---|---|---|---|
| 0 | — | — | 1.04 |
| 1 | .13 | .13 | 1.06 |
| 3 | .31 | .40 | 1.06 |
| 5 | .67 | .67 | 1.08 |
| 15 | 2.23 | 2.24 | 1.09 |

The model GL103 Power Source and control console (Gerling, Ibid.) combination employed here with provides a completely integrated power source for use in either laboratory or production assignments because it utilizes three phase input power and has a very low ripple output signal. This is accomplished through the use of a power transformer which has separate three phase secondaries, one Y connected and one delta connected, which are independently rectified and the dc outputs combined in series to give a 12 phase output ripple waveform having a very low peak to peak ripple with a minimum of filter components.

In practice, power output of the power source is adjusted by raising and lowering the current in the electromagnet surrounding the magnetron, thus raising and lowering the level of the magnetic field in the magnetron interaction space. If the field is high enough, no electrons will be able to cross the interaction space resulting in zero output. As the field is reduced, electrons are able to make the transition thus increasing the output. The current through the electromagnet is controlled by a solid state circuit using the current through the magnetron as a reference signal. This allows the output to be smoothly adjusted without waveform distortion at all levels from 0 to full power.

The control system contains two additional circuits which increase the versatility of this power source. The first is one which permits the power source to be controlled by an analog voltage. In this mode of operation, an output signal from 0 to −1 volt will cause the power source to go from a preset output to zero output.

In the second mode, the output can be regulated to an input reference voltage anywhere in the range of 0 to −1 volt. Typically, this control option allows the power output to be regulated against line voltage changes by using the signal from the power output meter as the reference.

The major characteristics of the power source are summarized as follows:

| | |
|---|---|
| Frequency | 2.45 + 30–20 GHz |
| Power Output | 2.75 kW min - 3.0 kW nom |
| Power Control | 0 to 3 kW |
| Power Waveform | Low ripple |
| Output Waveguide | WR284 |
| Output Flange | WR284 Cover Flange w/GL taper and pin alignment system for use with a V band single screw clamp |

In one practice of the present invention a plurality of ribbons formed of semiconductor material are disposed in spaced parallel relationship to each other so as to provide uniform distance ("d") between the axial center lines of each pair of adjacent parallel ribbons and a lesser proportionate distance (d/2) between the center line of the extreme ribbons/wafers and the adjacent housing wall. The adjacent housing walls function as an electrical reflector so that microwaves are impinged upon both planar surfaces of each ribbon so disposed. As arranged, each ribbon functions as a waveguide will within a composite waveguide system defined thereby within the sample holder. The ribbons so mounted are then placed in the operative traveling-wave field of a microwave generator, the traveling microwaves are impinged upon both planar surfaces of each of the several ribbons until the desired heat effect is obtained, the generator is deactivated and the ribbons unloaded from the sample holder for such subsequent handling as the exigencies of their intended use may require.

A preferred ceramic for use in the fabrication of the shelf-like members hereof is hydrous aluminum silicate which is available from General Electric under the tradename "Grade A Lava". This material can be readily formed prior to curing and thereafter fired to provide a very hard heat resistant electrically insulating ceramic shape. Of course, other heat resistant insulators such as fused quartz, sapphire, aluminum oxide, and like heat resistant ceramics, and even heat resistant Pyrex® glass (Corning) can be used to form the shelf-like member when the intended thermal operating conditions are such that the material can survive the cycle.

From the foregoing, it is apparent that means and methods have been herein described and illustrated which fulfill all of the aforestated objectives in a remarkably unexpected fashion. It is of course understood that such modifications, alterations and adaptations as may readily occur to the artisan confronted with this disclosure are intended within the spirit of this disclosure which is limited only by the scope of the claims appended hereto.

What is claimed is:

1. A waveguide holder for positioning thin semiconductor materials within a microwave field for heating thereby said holder comprising: an elongated hollow housing having a four walled rectangular cross section and a first and a second open end; a first and second shelf-like member, each mounted adjacent to a different one of said walled housing in spaced facing relationship to each other, each of said shelf-like members having a plurality of support surfaces disposed on the inner surface thereof in spaced substantially parallel relationship to each other, each said surface coacting with the corresponding one of said support surfaces on said other shelf-like member suspend one of a plurality of thin sheets of semiconductor material therebetween transversely of said housing, said sheets being disposed in spaced parallel relationship to each other.

2. A waveguide holder according to claim 1 in which each of said thin sheets of semiconductor material are disposed in a horizontal plane.

3. A waveguide holder according to claim 1 in which each of said thin sheets of semiconductor material are disposed in a vertical plane.

4. A waveguide holder according to claim 1 in which said shelf-like members are formed of heat resistant ceramic.

5. A waveguide holder according to claim 2 in which said shelf-like members are formed of heat resistant ceramic.

6. A waveguide holder according to claim 3 in which said shelf-like members are formed of heat resistant ceramic.

7. A waveguide holder according to claim 1 in which said housing has an annular flange member secured to each end thereof in spaced parallel relationship to each other, said flanges being adapted to secure said holder to an auxiliary component of a microwave circuit.

8. A waveguide holder according to claim 2 in which said housing has an annular flange member secured to each end thereof in spaced parallel relationship to each other, said flanges being adapted to secure said holder to an auxiliary component of a microwave circuit.

9. A waveguide holder according to claim 3 in which said housing has an annular flange member secured to each end thereof in spaced parallel relationship to each other, said flanges being adapted to secure said holder to an auxiliary component of a microwave circuit.

10. A waveguide holder according to claim 1 in which said adjacent ones of said plurality of thin sheets of semiconductor material are spaced equidistant from one another a distance "d" and the outermost sheets are spaced relative to said adjacent housing wall a distance "d/2".

11. A waveguide holder according to claim 4 in which said adjacent ones of said plurality of thin sheets of semiconductor material are spaced equidistant from one another a distance "d" and the outermost sheets are spaced relative to said adjacent housing wall a distance "d/2".

12. A waveguide holder according to claim 7 in which said adjacent ones of said plurality of thin sheets of semiconductor material are spaced equidistant from one another a distance "d" and the outermost sheets are spaced relative to said adjacent housing wall a distance "d/2".

13. A waveguide holder according to claim 1 having a width in inches divisible by 3.4 when the microwave frequency is 2.45 GHz.

14. A method for heating thin sheets of semiconductor materials with microwaves for a predetermined period, said method comprising: placing a plurality of thin sheets of semiconductor materials in spaced generally parallel relationship to each other; placing said spaced semiconductor materials in the operative traveling wave field of a microwave generator; impinging traveling microwaves upon said semiconductor materials for said predetermined period; and thereafter deactivating said traveling wave field.

15. A method according to claim 14 in which said microwave materials have a resistivity of from about 0.001 up to about 1.0 ohm-cm.

16. A method according to claim 15 in which said microwave materials have a resistivity of from about 0.001 up to about 0.1 ohm-cm.

17. A method according to claim 14 in which the frequency of said traveling wave field is 2.45 GHz.

18. A method according to claim 14 in which said operative traveling microwave field is generated through a resonator.

19. A method for heating a plurality of thin sheets of material having a resistivity of from about 0.001 to about 1.0 ohm-cm with a traveling microwave for a predetermined periods, said method comprising: placing a plurality of thin sheets of said material in spaced generally parallel relationship to each other; placing said spaced thin sheets in the operative traveling wave field of a microwave generator; impinging traveling microwaves upon said thin sheets for said predetermined period; and thereafter deactivating said traveling wave field.

* * * * *